United States Patent [19]

Graser et al.

[11] 4,184,626

[45] Jan. 22, 1980

[54] WRAP-AROUND BEVERAGE CARRIER WITH TOTAL SEPARATION

[75] Inventors: Earl J. Graser; Earl J. Killy, both of Monroe, La.

[73] Assignee: Olinkraft, Inc., Denver, Colo.

[21] Appl. No.: 959,531

[22] Filed: Nov. 13, 1978

[51] Int. Cl.[2] ..... B65D 5/02; B65D 5/48; B65D 65/24

[52] U.S. Cl. ..... 229/40; 206/434; 206/427

[58] Field of Search ..... 229/40, 29 E, 29 B, 229/29 C; 206/427, 429, 433

[56] References Cited

U.S. PATENT DOCUMENTS

| | | | |
|---|---|---|---|
| 2,839,235 | 6/1958 | Chidsey, Jr. | 229/40 |
| 2,975,934 | 3/1961 | Powell | 229/40 X |
| 3,161,344 | 12/1964 | Spery | 229/40 |
| 3,163,321 | 12/1964 | Weiss | 229/40 X |
| 3,182,794 | 5/1965 | Moore | 229/40 X |
| 3,257,066 | 6/1966 | Williams | 229/40 |
| 3,283,990 | 11/1966 | Tolaas | 229/40 |
| 3,554,431 | 1/1971 | Lock | 206/433 |
| 3,994,397 | 11/1976 | Fishlove | 206/429 |
| 3,999,660 | 12/1976 | Tranquillitsky | 229/40 |
| 4,084,693 | 4/1978 | Culpepper | 229/40 |

*Primary Examiner*—Davis T. Moorhead

*Attorney, Agent, or Firm*—Robert M. Krone; Joseph J. Kelly; Norvell E. Von Behren

[57] ABSTRACT

An improved wrap-around beverage carrier which provides for total separation between adjacent containers in the carrier is provided in the subject invention. In the preferred embodiment the carrier is designed to hold twelve cans of a given product and is designed in a one-piece configuration. The novel partitioning arrangement within the carrier permits total separation to prevent cans from coming in contact with each other during shipping, thereby avoiding abrasion marks on printed aluminum beverage cans. The novel divider structure is hinged from an interior partitioned panel and has a novel configuration of the panel wherein the novel configuration allows the partition to be used for total separation without requiring additional partition structures to be placed within the carrier.

12 Claims, 6 Drawing Figures

WRAP-AROUND BEVERAGE CARRIER WITH TOTAL SEPARATION

BACKGROUND OF THE INVENTION

This invention relates to wrap-around beverage container carriers and more particularly to a new and improved beverage container carrier which provides total can separation and in which the production blank may be made in a one-piece configuration in the preferred embodiment.

In the design of beverage container carriers it is desirable to be able to provide a carrier that provides paperboard separation between adjacent cans in order to eliminate unsightly abrasion marks on adjacent cans. It is also desirous in designing beverage container carriers such as this to be able to provide a production blank which is made in the least number of pieces possible in order to avoid costly gluing of the various pieces together to form the completed carrier. It is also preferable to have a one-piece carrier, thereby minimizing the scrapping of unused paperboard which would result from a carrier comprising several pieces.

SUMMARY OF THE INVENTION

In order to provide the optimum carrier having the features desired, there has been provided by the subject invention a new and improved wrap-around beverage container carrier which is formed in the preferred embodiment in a one-piece configuration and which has a plurality of new and novel shaped and positioned interior partitioned panels which permit total separation of the adjacent cans when the carrier is set up. The shapes of the glued areas anchoring the interior partition panels are designed to allow ease of can insertion. The longitudinal interior partition panels are formed from an extension of an interior top panel. A plurality of transverse divider tabs in the exterior top panel and the bottom panel, as well as the partial interior top panel, are an integral part of the complete can separation and are designed and positioned to be folded down in sequence to the insertion of the aluminum cans in the completed carrier.

Accordingly, it is an object and advantage of the invention to provide a new and novel wrap-around beverage container carrier which may be made in the preferred embodiment in a one-piece construction and which provides for complete separation of the adjacent cans without requiring additional partitions or insertions to be glued in the carrier prior to setup.

Yet another object and advantage of the invention is to provide a new and improved wrap-around beverage container carrier which may be utilized with a twelve can package of beverage containers and which is made with minimal amounts of paperboard thereby minimizing the cost of the carrier.

These and other objects and advantages of the invention will become apparent from a review of the drawings detailing the invention and from a reading of the Description of The Preferred Embodiment.

DESCRIPTION OF THE PREFERRED EMBODIMENT

Figure 1:
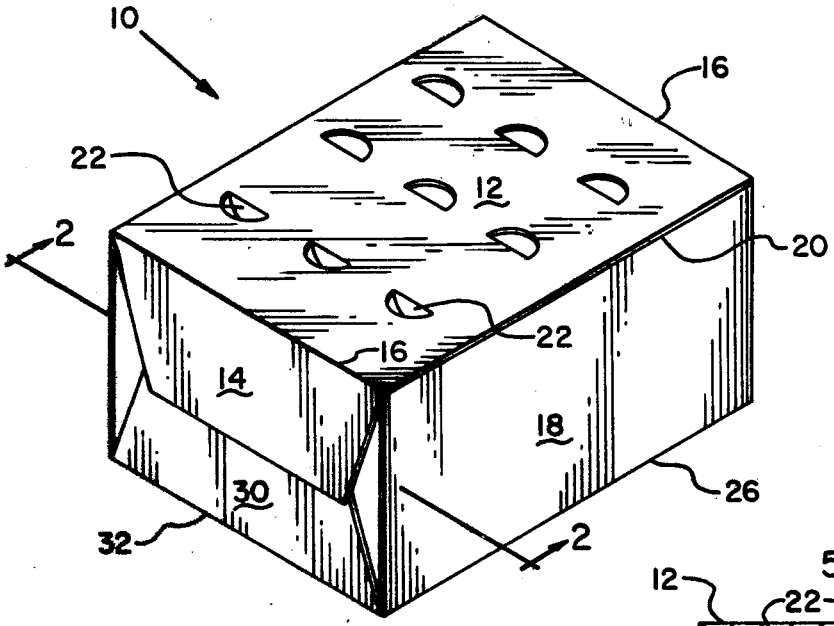
FIG. 1 is a perspective view of a twelve-can package of the type covered by the invention showing the plurality of inwardly turned tabs positioned on the exterior top panel of the package to provide can separation in the transverse direction.

Referring now to the drawings in general and in particular to FIG. 1 of the drawing, there is shown the one-piece, wrap-around beverage container carrier of the subject invention shown generally by the numeral 10 which comprises an exterior top panel 12, having a pair of side panels 14 hingedly attached thereto by means of the scoreline 16. The exterior top panel 12 also has hingedly attached thereto a first side panel 18 by means of the scoreline 20.

A plurality of inwardly turned tabs 22 are formed in the exterior top panel 12 and are positioned within the inside of the carrier 10 in such a manner that the plurality of tabs 22 provide total separation of the cans within the container in conjunction with divider partitions as will be hereinafter described.

Figure 6:
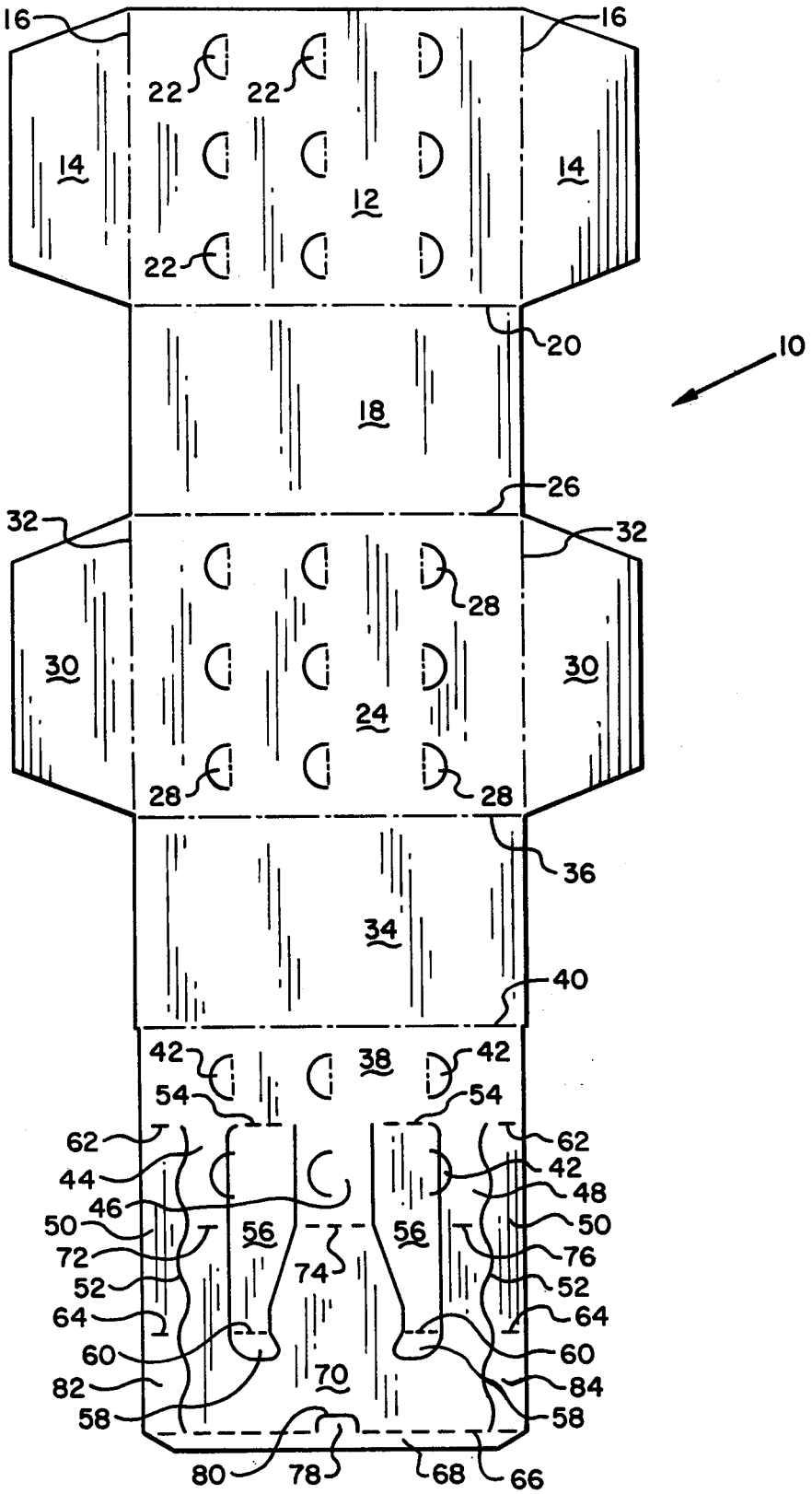
FIG. 6 is a plan view of the production blank of the preferred embodiment of the subject invention.

By referring now to FIGS. 1 and 6 there will be described the remaining structural features of the applicant's improved one-piece wrap-around beverage container carrier and how they relate to each other to provide the beforementioned separation. The first side panel 18 has hingedly attached thereto a bottom panel 24 by means of the scoreline 26. In addition the bottom panel 24 has formed thereon a plurality of inwardly turned tabs 28 similar in configuration to the inwardly turned tabs 22 contained on the exterior top panel 12. The bottom panel 24 also has a pair of side panels 30 attached thereto by means of the scoreline 32.

Hingedly attached to the bottom panel 24 is a second side panel 34 which is hingedly attached thereto by means of the scoreline 36. A partial interior top panel 38 is hingedly attached to the second side panel 34 by means of the scoreline 40. The partial interior top panel 38 also has formed thereon a plurality of die cut tabs 42 which are similarly positioned to the tabs 28 formed in the bottom panel 24 and the tabs 22 formed in the exterior top panel 12. Whenever the carrier of the subject invention is erected into the position shown in FIG. 1 of the drawing the respective plurality of tabs 22, 28 and 42 all function to provide total separation of the cans as will be described more fully hereinafter. The partial interior top panel 38 is formed with three spaced protuberances 44, 46 and 48 formed on the partial interior top panel 38 along one side thereof.

There is also formed a plurality of interior partition panels which are hingedly attached to the partial interior top panel 38 and to the plurality of protuberances 44, 46 and 48 forming the divider partition structure for the subject carrier. At least two of the interior partition panels are hingedly attached off of the partial interior top panel 38 and form panels in the shape of an undulation 50 formed by means of the wavy die cut line 52. In addition, at least two of the interior partition panels are formed in the shape of a foot-like configuration which is hingedly attached to the partial interior top panel 38 by means of the scoreline 54. These foot-like configuration partition panels are numbered 56 in the drawing FIG. 6 and have formed thereon securing means in the form of a tab 58 which is hingedly attached to the foot-like panel 56 by means of the scoreline 60.

The interior partition panels formed in the shape of the undulation 50 are also hingedly attached to the partial interior top panel 38 by means of the scoreline 62 and further have a second scoreline 64 formed throughout and also an elongated scoreline 66. The elongated scoreline 66 forms a securing means in the form of an elongated tab 68 formed between the two undulation partition panels 50.

When formed thusly it can be seen that the remaining section 70 forms an interior partition panel which is hingedly attached to the protuberances 44, 46 and 48 by means of the scorelines 72, 74 and 76. The remaining section 70 also has formed therein a tab 78 by means of the die cut 80 which is used to secure the interior partition remaining section 70 to the bottom panel 24 by means of adhesive or other securing means. In addition, the tabs 58 formed on the foot-like panel 56 are utilized to secure the foot-like panels 56 to the bottom panel 24 to secure those panels to the carrier.

Figure 3:
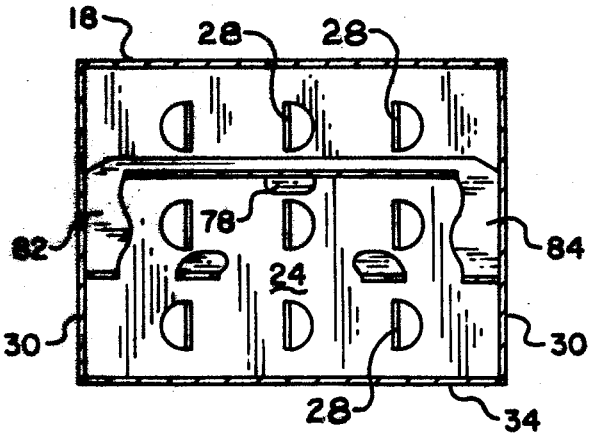
FIG. 3 is a sectional view, taken along line 3—3 of FIG. 2, showing the plurality of inwardly turned tabs positioned on the bottom panel which provide total can separation in the transverse direction in conjunction with the plurality of inwardly turned tabs beforementioned on the exterior top panel.

In addition the panel sections 82 formed between the scoreline 64 and the elongated scoreline 66 are also adhesively secured to the bottom panel 24 as shown more fully in FIG. 3 of the drawings.

Figure 2:
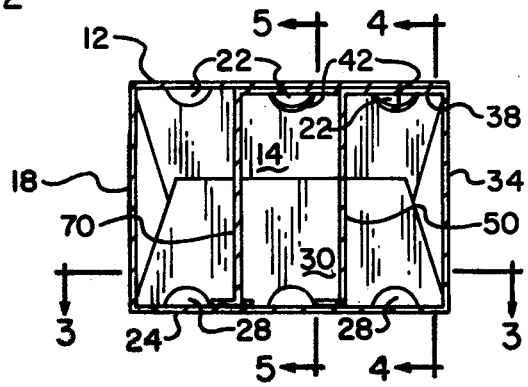
FIG. 2 is a sectional view, taken along line 2—2 of FIG. 1, showing the folding of the one-piece production blank utilized in the preferred embodiment.

Referring now to FIG. 2 of the drawing there is shown a sectional view, taken along line 2—2 of FIG. 1, showing the folding of the one-piece production blank utilized in the Preferred Embodiment so that the combination of interior partitions and inwardly turned tabs provide full can separation between adjacent cans. It can also be seen by referring to FIG. 3 of the drawing how the panel sections 82 and 84 are adhesively secured to the bottom panel 24 and how the tab 78 is also adhesively secured to the same bottom panel.

Figure 4:
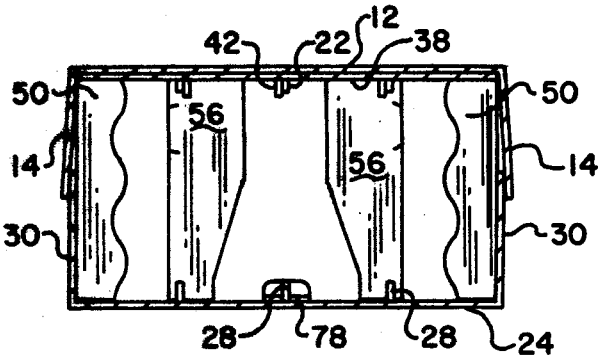
FIG. 4 is a sectional view, taken along line 4—4 of FIG. 2, showing the plurality of interior partition panels hingedly attached to the partial interior top panel and also showing the die cut formation on at least two of the interior partition panels in the shape of an undulation.
Figure 5:
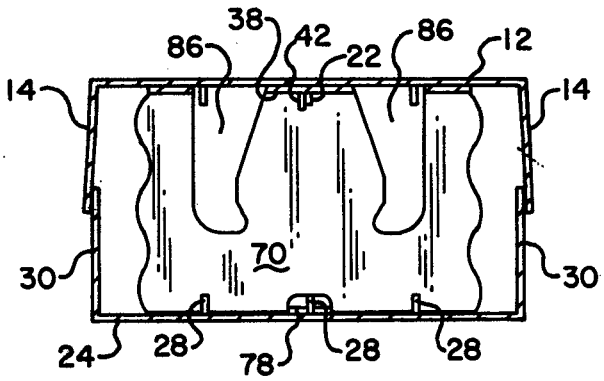
FIG. 5 is a sectional view, taken along line 5—5 of FIG. 2, showing the plurality of interior partition panels hingedly attached to the partial interior top panel and further showing the novel configuration of at least two of the interior partition panels which are formed in the shape of a foot-like configuration.

Referring now to FIG. 4 of the drawing there is shown a sectional view, taken along line 4—4 of FIG. 2, showing the plurality of interior partition panels hingedly attached to the partial interior top panel and also showing the die cut formation of at least two of the interior partition panels in the shape of the undulation. FIG. 5 is a sectional view, taken along line 5—5 of FIG. 2 showing the plurality of interior partition panels hingedly attached to the partial interior top panel and further showing the novel configuration of at least two of the interior partition panels which are formed in the shape of a foot-like configuration. It can be seen in FIG. 5 that whenever the remaining section 70 is adhesively secured to the bottom panel 24 by means of the elongated tab 68 that a pair of open spaces 86 are formed resulting from the foot-like panels 56 being cut from the structure.

It can also be seen by referring to FIG. 2 through FIG. 5 that the use of the inwardly turned plurality of tabs 22, 28 and 42 function to separate adjacent cans in the transverse direction both at the bottom of the carrier and the top of the carrier. In a similar manner the various interior partition panels 50, 56 and the remaining section panel 70 form total can separation in the longitudinal direction as a result of the novel formation of these panels by means of the undulating die cut line 52 and also by formation of two of the panels in a foot-like configuration.

As a result of this novel configuration no separate partition structure is required to be utilized in the carrier resulting in a much improved carrier as has been before mentioned. It can be seen by referring to FIGS. 4 and 5 that the side panels 14 and 30 may be adhesively secured together as is well known in the art and may also be locked together by means of side panel locks, which are also known in the art. When the partition structures are formed thusly, it can be seen that there are in essence seven interior partition divider legs which are hingedly attached to the partial interior top panel with four of the legs being in line longitudinally. The four legs comprise two undulation panels 50 and two foot-like panels 56. In addition, the remaining section panel 70 is formed as a single panel having three interior partition divider legs which separate eight adjacent cans in two rows which are positioned within the structure. The partial interior top panel 38 is formed in an elongated shape when the package is designed for handling twelve beverage containers and when formed thusly, the area of the elongated shape would be approximately one-third of the area of the exterior top panel 12.

From the foregoing it can be seen that there has been provided by the subject invention a new and novel carrier which accomplishes all of the advantages of the invention as defined. In addition, the subject invention may be modified by changing the various parts and structures of the invention without departing from the spirit and scope of the invention. It is within the spirit and scope of the invention that the interior partition panels may be also modified in their apparent shape in order to obtain the applicant's designed function of utilizing the shape of the partition panel to obtain the necessary can separation without the use of additional panels. It should also be apparent that the herein described embodiment has been given by way of illustration only and the applicant is not to be limited to the exact configuration shown in the drawings and described in the specification.

Having described our invention, we claim:

1. A one-piece wrap-around beverage container carrier comprising:

(a) an exterior top panel;

(b) a first side panel hingedly attached to the top panel;

(c) a bottom panel hingedly attached to the first side panel;

(d) a second side panel hingedly attached to the bottom panel;

(e) a partial interior top panel hingedly attached to the second side panel, the partial interior top panel also being fixedly attached to the exterior top panel;

(f) a plurality of interior partition panels hingedly attached to the partial interior top panel and fixedly attached to the bottom panel;

(g) the exterior top panel, the bottom panel, and the partial interior top panel having formed thereon a plurality of inwardly turned tabs positioned within the inside of the carrier in such a manner that the plurality of tabs in combination with the plurality of interior partition panels serve to provide full protection between adjacent containers to the beverage containers positioned within the carrier; and (h) a pair of side panels hingedly attached to the top panel and the bottom panel for enclosing the ends of the carrier whenever the carrier is set up with the beverage containers positioned within the carrier.

2. The one-piece wrap-around beverage carrier as defined in claim 1 further comprising seven interior partition panels being hingedly attached to the partial interior top panel.

3. The one-piece wrap-around beverage carrier as defined in claim 1 wherein the partial interior top panel is formed in an elongated shape and further having three equally spaced protuberances positioned thereon and extending towards the first side panel.

4. The one-piece wrap-around beverage carrier as defined in claim 3 wherein the elongated shape has an area approximately ⅓ of the area of the exterior top panel.

5. The one-piece wrap-around beverage carrier as defined in claim 3 wherein seven interior partition panels are utilized with four of the seven panels being hingedly attached to the elongated shape and three of the seven panels are hingedly attached to the three protuberances.

6. In an improved wrap-around beverage container carrier of the type having an exterior top panel, a bottom panel and two side panels hingedly attached together with a plurality of end panels enclosing the carrier, the improvement comprising:

(a) an interior top panel being positioned beneath the exterior top panel and having formed thereon a plurality of downwardly positioned interior partition panels which are fixedly attached to the bottom panel; and (b) a plurality of inwardly turned tabs being formed on the exterior top panel, the bottom panel and the interior top panel.

7. The improvement as defined in claim 6 wherein the interior top panel is formed integral with the carrier and is hingedly attached to one of the two side panels.

8. The improvement as defined in claim 7 wherein the interior partition panels are glued to the bottom panel.

9. The improvement as defined in claim 6 wherein four of the plurality of interior partition panels are formed in the shape of an undulation.

10. The improvement as defined in claim 6 wherein two of the interior partition panels are formed in the shape of a foot-like configuration.

11. A production blank for a one-piece wrap-around beverage container carrier comprising:

(a) an exterior top panel, (1) a pair of end flaps hingedly attached to the exterior top panel along a pair of fold lines, (2) a plurality of tabs hingedly attached to the exterior top panel along a plurality of fold lines;

(b) a first side panel hingedly attached to the exterior top panel along a fold line;

(c) a bottom panel hingedly attached to the first side panel along a fold line, (1) a pair of end flaps hingedly attached to the bottom panel along a pair of fold lines, (2) a plurality of die cut tabs hingedly attached to the bottom panel along a plurality of fold lines;

(d) a second side panel hingedly attached to the bottom panel along a fold line;

(e) a partial interior top panel hingedly attached to the second side panel along a fold line, (1) a plurality of die cut tabs hingedly attached to the interior top panel along a plurality of fold lines, (2) a plurality of spaced protuberances formed on the partial top panel along one side thereof, (3) a plurality of interior partition panels hingedly attached to the partial interior top panel and to the plurality of protuberances, (a) at least two of the interior partition panels being formed in the shape of an undulation, and (b) at least two of the interior partition panels being formed in the shape of a foot-like configuration.

12. The production blank as defined in claim 1 further comprising the interior partition panels having formed thereon means for securing the interior partition panels to the bottom panel at pre-determined positions.

* * * * *